US006002573A

United States Patent [19]

Partridge

[11] Patent Number: 6,002,573

[45] Date of Patent: Dec. 14, 1999

[54] SELF-BALANCING SHIELDED BIPOLAR IONIZER

[75] Inventor: Leslie W. Partridge, Davis, Calif.

[73] Assignee: Ion Systems, Inc., Berkeley, Calif.

[21] Appl. No.: 09/006,773

[22] Filed: Jan. 14, 1998

[51] Int. Cl.[6] ..... H01T 23/00

[52] U.S. Cl. ..... 361/231; 361/213; 361/229

[58] Field of Search ..... 361/213, 220, 361/225, 229, 230, 231, 232, 233, 235; 96/63, 95, 97; 250/324–326

[56] References Cited

U.S. PATENT DOCUMENTS

| | | | |
|---|---|---|---|
| 2,834,898 | 5/1958 | Partridge | 310/111 |
| 2,865,366 | 12/1958 | Partridge | 128/2.06 |
| 3,386,003 | 5/1968 | Partridge | 317/17 |
| 3,456,212 | 7/1969 | Partridge | 331/117 |
| 3,466,558 | 9/1969 | Partridge | 330/10 |
| 3,469,115 | 9/1969 | Partridge | 307/268 |
| 3,477,421 | 11/1969 | Partridge | 128/2.06 |
| 3,636,449 | 1/1972 | Partridge | 324/157 |
| 3,812,845 | 5/1974 | Partridge | 128/2.06 R |
| 4,077,413 | 3/1978 | Partridge | 128/419 |
| 4,319,302 | 3/1982 | Moulden | 361/213 |
| 4,331,158 | 5/1982 | Partridge | 128/709 |
| 4,729,057 | 3/1988 | Halleck | 361/213 |
| 5,055,963 | 10/1991 | Partridge | 361/231 |
| 5,057,966 | 10/1991 | Sakata et al. | 361/213 |
| 5,153,811 | 10/1992 | Rodrigo et al. | 361/231 |
| 5,539,631 | 7/1996 | Partridge | 363/27 |

*Primary Examiner*—Jeffrey Gaffin
*Assistant Examiner*—Kim Huynh
*Attorney, Agent, or Firm*—Fenwick & West LLP

[57] ABSTRACT

An air ionizer comprises at least two electrodes contained within a recessed region of an insulating housing. When high voltages are applied to the electrodes, nearby air molecules are ionized and generally move towards a target region outside the housing. Because the insulating housing shields the electrodes, the production of ions is not significantly disturbed by charged or grounded objects other than those in the general direction of the target region. In one embodiment, the electrodes are placed close enough to the inner walls of the recessed region that the portions of the surfaces of the walls near the electrodes are electrostatically charged. This charge tends to repel the nearby ions, expelling many from the recessed region towards the target region.

8 Claims, 4 Drawing Sheets

Sectional View of Ionizer

Top View of Ionizer

Sectional View of Ionizer

Side View of Ionizer

Sectional View of Ionizer

Primary Circuit Board

Secondary Circuit Board

SELF-BALANCING SHIELDED BIPOLAR IONIZER

FIELD OF INVENTION

This invention relates generally to the field of air ionization, and more particularly to air ionizers which produce both positive and negative ions.

BACKGROUND OF THE INVENTION

An increased ion content in ambient air can reduce the electrostatic charge on objects in the environment. In fields where electrostatic discharge poses serious problems, such as the semiconductor chip fabrication field, the use of air ionizers is common. An air ionizer typically includes sharply pointed electrodes, to which high voltages are applied. Gas molecules near the electrodes, especially near the sharply pointed tips, become ionized when they either gain or lose electrons. Because the ions take on the charge of the nearest electrode, and like charges repel, they are repelled from that electrode. In typical air ionizers, an air current is introduced to the device in order to carry the ions away from the electrodes to a "target region" where an increased ion content is desired.

Ions in the air are attracted to objects carrying an opposite charge. When an ion comes in contact with an oppositely charged object, it exchanges one or more electrons with the object, lessening or eliminating the charge on the object, which makes electrostatic discharge less likely. Excess electrostatic charges on objects may also attract dust and other particulate contaminants. By reducing or eliminating excess electrostatic charge, ions in the air can reduce contamination of objects in the environment.

When ionized air is used to control electrostatic changes on objects in the environment, increased levels of both positive and negative ions are necessary. The stray electrostatic charges which build up on the objects to be protected can be of either polarity. If increased levels of ions of both polarities are present in the region of an object, ions which have a charge opposite that of the object are attracted to the object, which tends to neutralize the charge on the object. To the degree that the total charge of positive ions in a region is the same as the total charge of negative ions, the region is said to be "balanced." If the ion content in the region of an object is unbalanced, the more predominant ions may actually impart a charge to otherwise uncharged objects. For this reason, it is important that air ionizers which are used to control electrostatic charges produce a balanced number of positive and negative ions, and that the balance is present in the target region.

Several methods are used to make the ion content of the target region more balanced. U.S. Pat. No. 5,055,963 to Leslie W. Partridge, which is incorporated by reference herein in its entirety, discloses some methods for balancing the ion content of the target region. One method is to minimize the exposed surface area of the grounded components of the ionizer, and to position such grounded components in the ionizer such that they are, to the extent possible, equally distant from each electrode. This reduces the tendency of ions from one electrode to be attracted to ground, allowing more ions of the opposite polarity to reach the target region.

Another technique is to place electrodes of opposite polarity near each other to minimize the differences between the paths of ions from either electrode to objects in the target region. Such differences can result in an increased number of ions of one polarity in some parts of the target region. This technique is limited because locating electrodes of opposite polarity near each other increases the number of ions which simply move between the two electrodes, decreasing the number of ions which end up in the target region. Thus, locating electrodes near each other increases ion balance, but negatively affects the overall ion content level.

To help ensure that the numbers of ions produced by the electrodes are balanced, the high voltage supply, which is connected to the electrodes, can be isolated from ground. This allows the high voltage supply, and the electrodes, to acquire a Direct Current (D.C.) bias which acts to reduce any unbalance in the ions produced. When a molecule of one of the gases constituting air becomes positively ionized at a positive electrode, it loses at least one electron to the positive electrode, imparting a negative charge, equal in magnitude to the positive charge acquired by the molecule, to the entire high voltage supply. When a negative ion is produced at a negative electrode, at least one electron is removed from the electrode, imparting a positive charge to the high voltage supply. If the total charge of all positive ions produced is equal in magnitude to the total charge of all negative ions produced, the effect of these charges on the high voltage supply will cancel out, and no D.C. bias will be acquired. If more ions of positive polarity are produced, however, the high voltage supply will gain a D.C. bias of negative polarity. This D.C. bias causes more negative ions to be produced, until balance in the number of ions of each polarity has again been achieved. The same mechanism acts to produce more positive ions when too few have been produced.

While these efforts at balancing the ions in the target region are largely successful, some imbalances in the target region may still occur when these methods are used. Because conventional air ionizers use an airflow past the electrodes to carry the ions to the target region, conventional ionizers are open on at least one side other than the side facing the target region. This allows ions, which may move much faster than the air flow, to interact with charged and grounded objects located outside the ionizer and the target region. Such interaction diminishes the number of ions in the target region, and may act to unbalance the ion production.

In the case of an ionizer which is to be used very near a target region, or near grounded objects outside of the target region, the ion content in the target region may be unbalanced. When objects in the target region are nearer the electrodes, it is more likely that there will be asymmetrical coupling, leading to unbalanced ion content in the target region. Also, other grounded objects near the ionizer have a tendency to draw away many of the ions, leaving fewer in the target region. If the coupling with these objects is asymmetrical, then the ion content will likely be further unbalanced. What is needed is an air ionizer which delivers a balanced distribution of ions to a nearby target region in an environment which may contain grounded objects near the ionizer in a direction other than that of the target region.

DISCLOSURE OF THE INVENTION

An air ionizer embodying the present invention comprises at least one pair of electrodes mounted inside a housing made of insulating material. The housing includes a "recessed region" which is open to the ambient air on only one side, directed towards a target region. Electrodes ionize air inside the recessed region of the housing, and the ions are able to leave the housing only in the direction of the target region. Because the insulated housing shields the electrodes from any grounded objects other than those in the direction of the target region, more of the ions make it to the target region, as compared to conventional ionizers. Also, because the housing shields the electrodes from grounded objects which might unbalance the ion production, a more balanced production of ions may be achieved over conventional methods.

In one embodiment, the electrodes are located near enough to the insulating material of the housing that the surfaces of the inside walls of the housing acquire an electrostatic charge of the same polarity as the nearest electrode. The ions produced by each electrode are then repelled, not only by the electrode, but also by the nearby housing walls. This acts to force the ions from the housing at a high enough velocity for them to reach a target region which is some distance away.

DETAILED DESCRIPTION

Figure 1A:
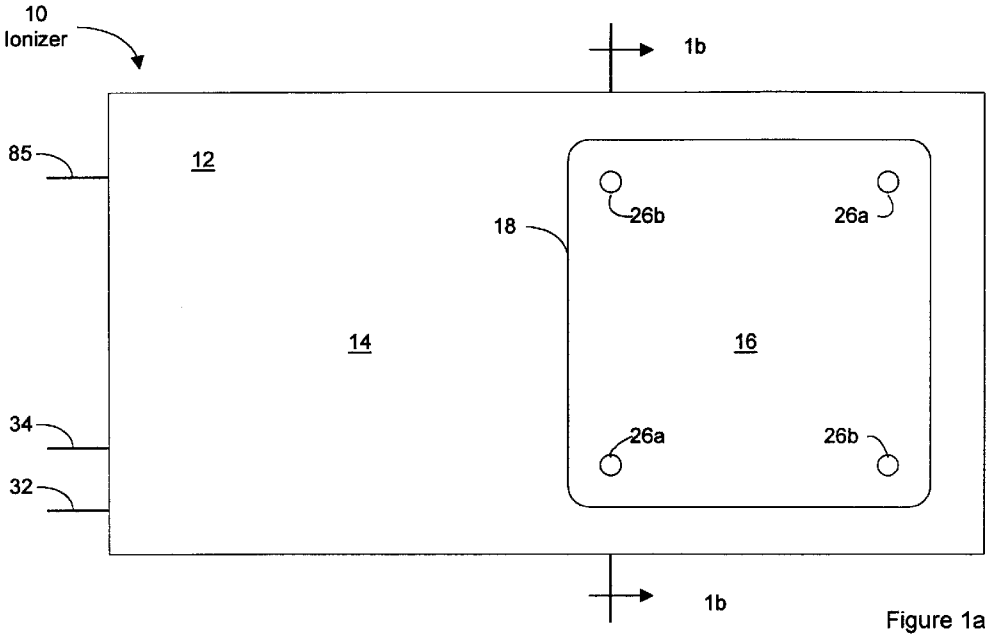
FIG. 1*a* is a top view of an air ionizer according to the present invention.
Figure 1B:
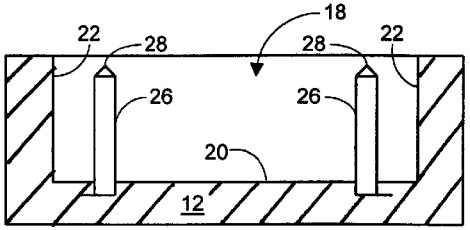
FIG. 1*b* is a sectional view of an air ionizer according to the present invention.
Figure 1C:
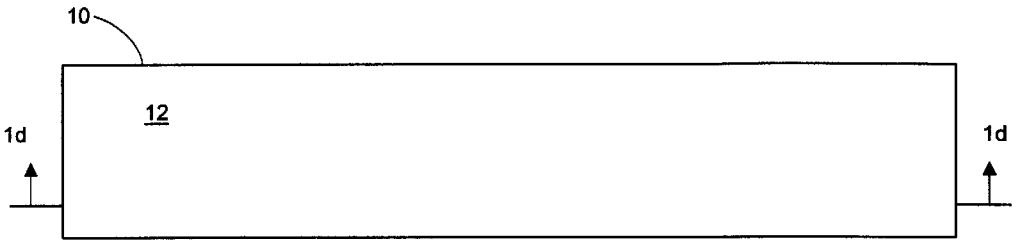
FIG. 1*c* is a side view of an air ionizer according to the present invention.
Figure 1D:
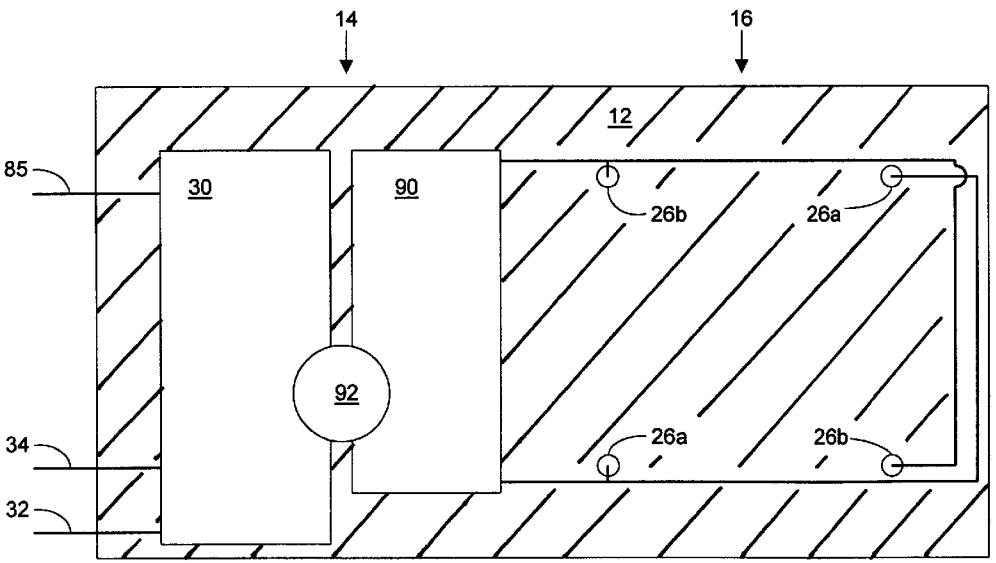
FIG. 1*d* is a sectional view of an air ionizer according to the present invention.

Referring now to FIGS. 1*a* through 1*d*, an embodiment of an air ionizer constructed in accordance with the present invention is shown to include a housing 12. In this embodiment, the housing 12 includes a voltage supply section 14 and an electrode section 16. In other embodiments the two sections may be parts of separate housings. The electrode section 16 includes a recessed region 18 with only one side open to the ambient air. The recessed region 18 is generally rectangular, with rounded corners. Alternatively the recessed region 18 may be shaped differently, for example in a circular configuration. The five walls of the recessed region 18 include a base 20 opposite the side which is open to the ambient air, and four sides 22 which extend from the base 20 to the open side.

The electrode section 16 of the housing 12 is constructed of insulating material, such as polytetrafluoroethylene (e.g. "TEFLON") or polycarbonate. The use of insulating material in the electrode section 16 of the housing 12 generally shields the interior of the recessed region 18 from any ion current flow to objects outside the recessed region 18, other than those objects near the "target region" which is in the direction of the open side of the recessed region 18. The insulating material in the electrode section 16 of the housing 12 also effectively reduces or eliminates any current flow through the housing 12 or over the surface of the housing 12 from the recessed region 18 to grounded components of the ionizer.

Inside the recessed region 18 a number of air ionizing electrodes 26 are mounted on base 20. These electrodes 26 cause molecules of the gases constituting air to ionize when large voltages are applied to them. In this embodiment, four electrodes 26 are present, although in other embodiments the number of electrodes 26 may be as low as two, and may be higher than four. The use of more electrodes 26 tends to produce a more balanced ion content in the target region, but it also adds to the complexity of the ionizer 10. While the electrodes 26 in this embodiment extend from the base 20 towards the open end of the recessed region 18, in other embodiments the electrodes 26 may extend from the sides 22 of recessed region 18. Preferably, the tips 28 of electrodes 26 are sharply pointed to produce a more intense electrical field at the tips 28, resulting in a more efficient production of ions than would be possible with blunt tips. In this embodiment, the tips 28 are within the shielded region of the recessed region 18, and do not extend beyond the open end of the recessed region 18.

The electrodes 26 are preferably arranged symmetrically, in order to reduce unbalances of ion content in the target region. The electrodes 26 are placed near the comers of the recessed region 18, with negative electrodes 26*a* situated diagonally across from one another, and positive electrodes 26*b* situated diagonally across from one another. In embodiments where more than four electrodes 26 are used, they may form a circle, with like polarities symmetrically situated. The symmetrical distribution of electrodes 26 reduces the possibility that the cloud of ions emanating from the ionizer 10 will contain clumps of unbalanced ions.

In an alternate embodiment, a thin aluminum band is wrapped around the housing 12 away from the recessed region 18 and the tips 28. This band is grounded, and wrapped around the housing in such a way as to be symmetrically located with respect to electrodes 26 of both polarities. This small amount of symmetrical coupling tends to allow charged objects in the target region to discharge more quickly. Also, since the coupling due to the band is symmetrical, it tends to not cause unbalance in the ion content of the target region.

Because the housing 12 in which the electrodes 26 are situated has only one open side, directed towards the target region, there is no deliberate airflow past the electrodes 26, as there is in conventional ionizers. Particularly, because there is no opening in the base 20 of the housing on the side opposite the target region, there is no ion current flow in that direction. In ionizers which deliberately pass an airflow past the electrodes, the air velocity is generally slower than the ion current speed. For this reason, ions may leave such an ionizer in the direction of any opening in the housing, seeking out charged or grounded objects other than those of the target region. This results in loss of ions and possible unbalanced ion content in the target region. In the present invention, the insulated housing 12 prevents ions from leaving the housing 12 in directions other than the target region, causing the ion content of the target region to be more balanced.

In this embodiment, the electrodes 26 are placed approximately 0.1 to 0.2 inches from the sides 22 of the recessed region. Because each side 20, 22 is insulated, and does not pass a direct current, it builds up an electrostatic charge on the surface which has the same polarity as the nearest electrode 26. The electrostatic charges on the sides 20, 22 tend to repel ions created at the nearest electrodes 26, causing many of the ions to be ejected from the recessed region 18. Most of the ions not ejected from the recessed region 18 are attracted to an electrode 26 of opposite polarity and is neutralized. This tendency of ions to simply move from one electrode to another limits how close electrodes 26 of opposite polarity may be situated. In the illustrative embodiment, electrodes 26 of opposite polarity are placed approximately 0.8" apart. This distance reflects a trade-off between locating electrodes 26 near each other, which results in less unbalance of ions in the target region, and locating electrodes 26 far apart, which results in more ions being ejected from the recessed region 18 and making it to the target region. The distance the electrodes 26 are located from the sides 22 also reflects a trade-off. By locating the electrodes 26 near the sides 22, ions are ejected from the recessed region 18, as discussed above. However, if the electrodes 26 are too close to the sides 22, the charges on sides 22 tend to inhibit the field at the tips 28.

Figure 3:
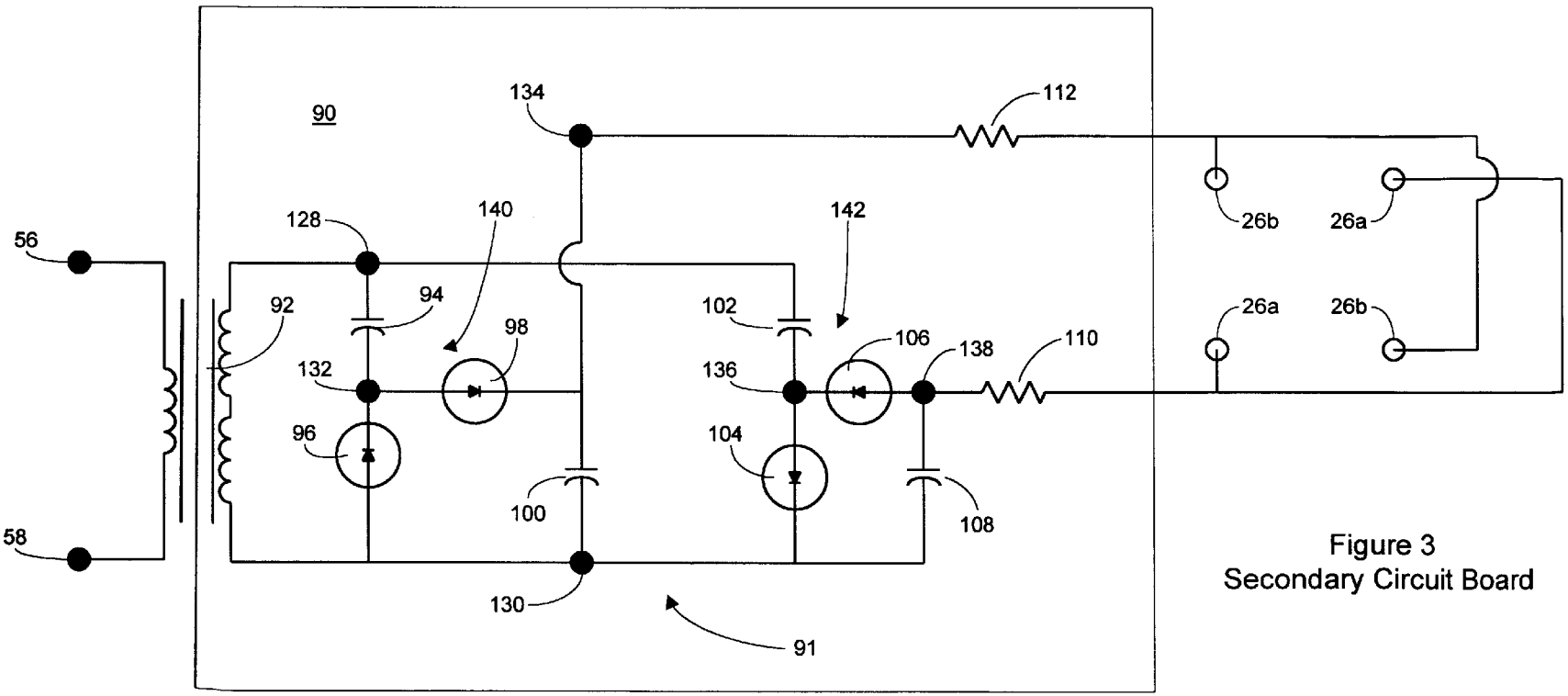
FIG. 3 is a schematic of the high voltage side of the power supply.

Preferably, the high voltages applied to electrodes 26 are generated by high voltage supply 91, illustrated in FIG. 3. High voltage supply 91 is isolated against any D.C. leakage to ground to a high degree, in order that it may acquire a D.C. bias in response to an unbalanced production of ions. The polarity of the D.C. bias acquired by high voltage supply 91 is the opposite of the polarity of the over-produced ions. Because the D.C. bias causes increased numbers of ions to be produced with the same polarity as the bias, and fewer ions to be produced with the opposite polarity, the bias acts to reduce or eliminate any unbalance in the ratio of ions produced by electrodes 26.

Figure 2:
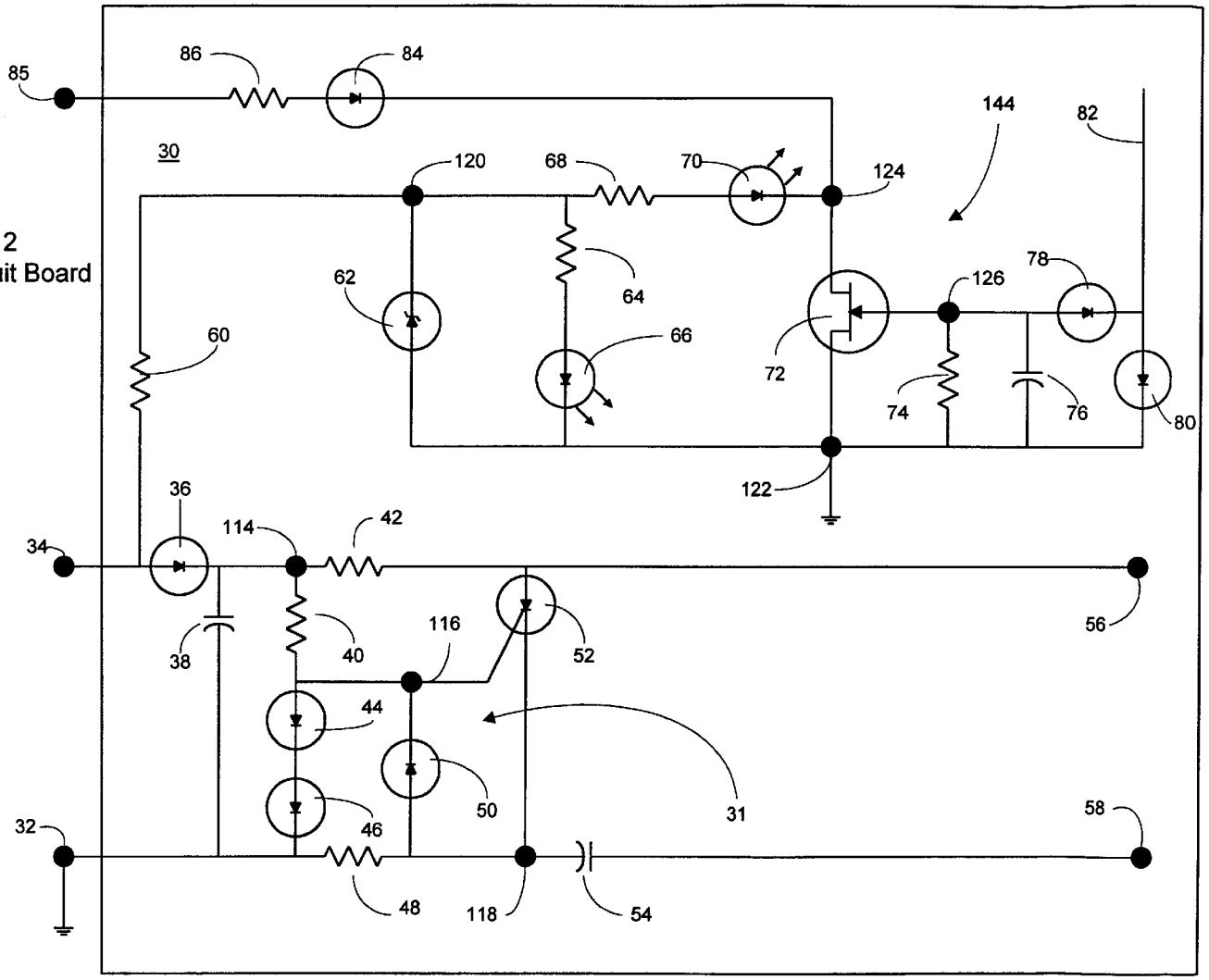
FIG. 2 is a schematic diagram of the low voltage side of the power supply.

In the embodiment of FIG. 2, a low voltage supply 31 is situated on printed circuit board 30. Terminals 32 and 34 are connected to an external power source which supplies 24 volt alternating current to terminal 34 and connects terminal 32 to ground. Diode 36 and capacitor 38 are connected across terminals 34 and 32 so as to change the alternating voltage to a direct voltage. The junction between diode 36 and capacitor 38 is junction 114, which is also connected to resistors 42 and 40. Resistor 42 is connected between junction 114 and terminal 56, which is connected to the low voltage winding of transformer 92 in FIG. 3. Terminal 58 is connected to the other side of the low voltage winding of transformer 92, and is connected to ground 32 through capacitor 54 and resistor 48. Resistor 40 is connected between junctions 114 and 116. Diodes 44 and 46 are connected between junction 116 and ground 32, so as to conduct positive current from junction 116 to ground 32. Diode 50 is connected to conduct positive current from junction 118, which is between capacitor 54 and resistor 48, to junction 116. Junction 116 acts as a gate for the Silicon Controlled Rectifier (SCR) 52, which is connected to conduct positive current from terminal 56 to junction 118 when the voltage of junction 116 is negative.

When power is supplied to terminal 34, this circuit acts to discharge capacitor 54 through the primary winding of transformer 92 once per cycle, inducing a large voltage between terminals 128 and 130, the terminals of the high voltage winding of the transformer 92. The high voltage supply 91 of the illustrative embodiment is located on printed circuit board 90, which is separated from printed circuit board 30 to enhance the electrical isolation between the two parts, 31 and 91, of the power supply. Terminals 128 and 130 are both connected to a positive high voltage side 140 and a negative high voltage side 142 of the high voltage supply 91. The positive high voltage side 140 of the circuit 91 includes a capacitor 94 which is connected between terminal 128 and junction 132. Also connected to junction 132 are diodes 96 and 98, with diode 96 oriented to conduct positive current from terminal 130 to junction 132, and diode 98 oriented to conduct positive current away from junction 132 to junction 134. Capacitor 100 is connected between terminal 130 and junction 134 in order to maintain a positive voltage on junction 134, which is connected to the positive high voltage electrodes **26*b* through resistor 112. The negative high voltage side 142 of the circuit includes a capacitor 102 which is connected between terminal 128 and junction 136. Also connected to junction 136 are diodes 104 and 106, with diode 104 oriented to conduct positive current from junction 136 to terminal 130, and diode 106 oriented to conduct positive current to junction 136 from junction 138. Capacitor 108 is connected between terminal 130 and junction 138 in order to maintain a negative voltage on junction 138, which is connected to the negative high voltage electrodes 26*a* through resistor 110. The high voltages maintained on electrodes 26** may be in the range of approximately 5 KV to 15 KV.

As illustrated in FIG. 2, this embodiment includes an alarm circuit 144 on printed circuit board 30. This circuit 144 includes an antenna 82, which may be a simple conductive trace on printed circuit board 30. This antenna 82 is connected to diodes 78 and 80 such that positive current is conducted from junction 126 to antenna 82 through diode 78, and positive current is conducted from antenna 82 through diode 80 to junction 122, which is connected to ground. Resistor 74 and capacitor 76 are also connected in parallel between junctions 126 and 122, for maintaining a bias on the gate of Field Effect Transistor (FET) 72 while a signal is reaching the antenna 82. When the high voltage power supply 91 is working correctly, a radio frequency signal naturally results, and this reaches the antenna 82 through the air. If the power supply is not working correctly, then no signal will reach antenna 82, and FET 72 will allow current to flow between junction 124 and ground 122. Junction 124 is connected to alarm output terminal 85 by way of resistor 86 and diode 84, which is oriented to allow positive current to flow from terminal 85 to junction 124. When power is applied to terminal 34, current flows to junction 120 of the alarm circuit 144 through resistor 60. Positive current flows through resistor 64 and Light Emitting Diode (LED) 66 to ground 122. Zener diode 62 is connected between junction 120 and ground 122 so as to protect the FET 72 from overvoltage on its drain electrode. LED 66 emits light to indicate that the power supply is receiving power through terminal 34. When the power supply is receiving power through terminal 34 but no signal is received at antenna 82, a current flows from junction 120 through resistor 68, LED 70, and FET 72 to ground 122. LED 70 emits light to indicate that, although power is being applied to the circuit, no ionization is occurring. The same event allows current to flow from terminal 85 to ground 122. Terminal 85 may be connected to some external alarm device which signals a problem with the ionizer 10, in addition to the indication given by LED 70.

In order to ensure that any D.C. bias introduced by the unbalanced production of ions does not leak to ground, it is advantageous to ensure a high level of insulation between the high voltage supply and any ground source. In the illustrative embodiment, this is accomplished by physically separating the low voltage and high voltage printed circuit boards 30 and 90, by using insulating tape in transformer 92 between the primary and secondary windings, and by potting the circuit boards 30 and 90 in epoxy or silicone. These methods can result in an electrical isolation between the electrodes 26 and the low voltage power supply 31 of 30 tera-ohms.

The above description is included to illustrate the operation of an illustrative embodiment and is not meant to limit the scope of the invention. The scope of the invention is to be limited only by the following claims. From the above description, many variations will be apparent to one skilled in the art that would be encompassed by the spirit and scope of the present invention.

What is claimed is:

1. An air ionizing apparatus comprising:

a housing comprising insulating material, with a recessed region which is open to ambient air on only one side;

a first electrode and a second electrode coupled to the housing within the recessed region, each electrode having an ionizing end exposed to the ambient air, for causing air molecules to ionize in response to high voltages applied to the first electrode and the second electrode, the ionizing ends of the first electrode and the second electrode being within the recessed region; and a high voltage supply coupled to the first electrode and the second electrode, for producing positive ions and negative ions by simultaneously applying high voltages of different polarity to the first electrode and the second electrode, for ionizing the air near each of the first electrode and the second electrode to become ionized.

2. The air ionizing apparatus of claim 1 wherein the high voltage supply is substantially isolated from ground, and responsive to an unbalance in the relative production of positive ions and negative ions, acquires a D.C. bias voltage which is applied to the first electrode and the second electrode.

3. The air ionizing apparatus of claim 2 wherein the D.C. bias voltage causes an increased production of one polarity of ions for reducing the unbalance.

4. The air ionizing apparatus of claim 1 wherein the end of each electrode which is exposed to ambient air is thinner than the remainder of the electrode.

5. The air ionizing apparatus of claim 1 wherein the first electrode and the second electrode are positioned in the recessed region for causing a portion of the interior surface of the recessed region near each electrode to acquire an electrostatic charge of the same polarity as the electrode, causing ions of the same polarity as the electrode to be repelled from the portion, and causing some ions to be expelled from the recessed region.

6. The air ionizing apparatus of claim 1 further comprising:

a third electrode and a fourth electrode coupled to the housing within the recessed region, each electrode having an ionizing end exposed to the ambient air, for causing air molecules to ionize in response to high voltages applied to the third electrode and the fourth electrode, the ionizing ends of the third electrode and the fourth electrode being within the recessed region; and the high voltage supply is coupled to the third electrode and the fourth electrode, for producing positive ions and negative ions by simultaneously applying high voltages of different polarity to the third electrode and the fourth electrode, for ionizing the air near each of the third electrode and the fourth electrode to become ionized.

7. The air ionizing apparatus of claim 6 wherein the ionizing ends of the electrodes are located to cause the polarity of ions produced by the electrodes to be symmetrical about a line extending from the interior of the housing to the open side of the recessed region.

8. An air ionizing apparatus comprising:

a housing comprising insulating material, with a recessed region which is open to ambient air on only one side;

at least two electrodes coupled to the housing within the recessed region, each electrode having an ionizing end exposed to ambient air, the ionizing ends being within the recessed region, and each electrode, responsive to a high voltage, causing air molecules to ionize, and causing a portion of the surface of the interior of the recessed region near the electrode to acquire an electrostatic charge of the same polarity as the electrode; and a high voltage supply which is substantially isolated from ground, coupled to the electrodes, for producing positive ions and negative ions by simultaneously applying high voltages of a first polarity to a subset of the electrodes and applying high voltages of the other polarity to the electrodes not in the subset; and responsive to an unbalance in the relative production of positive ions and negative ions, acquiring a D.C. bias voltage which is applied to the electrodes, causing an increased production of one polarity of ions to reduce the unbalance.

* * * * *